United States Patent [19]

Okamoto et al.

[11] Patent Number: 4,887,769

[45] Date of Patent: Dec. 19, 1989

[54] ELECTROMAGNETIC FUEL INJECTION VALVE

[75] Inventors: Yoshio Okamoto; Yozo Nakamura, both of Ibaraki; Kyoichi Uchiyama, Kashiwa; Haruo Watanabe; Tokuo Kosuge, both of Ibaraki; Akira Onishi, Tsuchiura; Akashi Terasaki; Hiroyuki Ando, both of Katsuta; Eiji Hamashima, Ibaraki, all of Japan

[73] Assignee: Hitachi, Ltd., Tokyo, Japan

[21] Appl. No.: 211,261

[22] Filed: Jun. 24, 1988

[30] Foreign Application Priority Data

| | | | |
|---|---|---|---|
| Jun. 26, 1987 | [JP] | Japan | 62-157527 |
| Sep. 25, 1987 | [JP] | Japan | 62-238752 |
| Jan. 13, 1988 | [JP] | Japan | 63-3737 |

[51] Int. Cl.[4] ..... B05B 1/30; B05B 1/34

[52] U.S. Cl. ..... 239/493; 239/497; 239/585; 251/127; 251/129.22

[58] Field of Search ..... 239/585, 492, 493, 494, 239/496, 497; 251/129.22, 127

[56] References Cited

U.S. PATENT DOCUMENTS

| | | | |
|---|---|---|---|
| 1,040,827 | 10/1912 | White | 239/493 |
| 4,274,598 | 6/1981 | Wilfert et al. | 239/585 |
| 4,360,161 | 11/1982 | Claxton et al. | 239/585 |
| 4,365,746 | 12/1982 | Tanasawa et al. | 239/585 |

FOREIGN PATENT DOCUMENTS

| | | | |
|---|---|---|---|
| 56-75955 | 6/1981 | Japan . | |
| 409889 | 5/1934 | United Kingdom | 239/493 |

*Primary Examiner*—Andres Kashnikow
*Assistant Examiner*—Karen B. Merritt
*Attorney, Agent, or Firm*—Antonelli, Terry & Wands

[57] ABSTRACT

An electromagnetic fuel injection valve in which an area of an annular gap formed by a ball valve and a valve seat when the ball valve is lifted is made smaller than cross sectional area of grooves provided on a fuel swirling element which gives fuel supplied a swirling force and further is made larger than a cross sectional area of a fuel injection port, whereby the fuel is injected with an excellent atomizing characteristic.

5 Claims, 8 Drawing Sheets

ELECTROMAGNETIC FUEL INJECTION VALVE

BACKGROUND OF THE INVENTION

The present invention relates to an electromagnetic fuel injection valve.

As disclosed in Japanese Patent Unexamined Publication No. 56-75955, a prior art fuel injection valve has, in a housing, a swirl plate provided with a guide hole receiving a ball and a swirl passage for introducing fuel substantially in a tangential direction into the guide hole.

In the above-described prior art, consideration has not been given to the fact that, when the pressurized fuel is passed through the swirl passage and the four fuel passage holes in communication with the swirl passage, the inherent energy of the fuel must be converted sufficiently into the swirl velocity energy with little loss. Thus, the prior art has a problem that it is not possible to effectively spray the fuel.

SUMMARY OF THE INVENTION

An object of the invention is to provide an electromagnetic fuel injection valve capable of converting pressurized fuel into swirled fuel with little pressure loss to effect a fuel injection with excellent atomizing characteristics.

According to a first aspect of the invention, there is provided an electromagnetic fuel injection valve comprising a fuel swirling element disposed upstream of a valve seat for imparting a swirling motion to fuel, a fuel injection port formed downstream of said valve seat and a ball valve for injecting the fuel, swirled by said fuel swirling element, from said fuel injection port, and in which an amount of the fuel to be injected is controlled by controlling an opening and closing time period of the ball valve, wherein an area of an annular gap formed between the ball valve and the valve seat when the ball valve is lifted is made smaller than a cross sectional area of grooves of the fuel swirling element and is made larger than a cross sectional area of the fuel injection port.

According to a second aspect of the invention, there is provided an electromagnetic fuel injection valve comprising a fuel swirling element disposed upstream of a valve seat for imparting a swirling motion to fuel, a fuel injection port formed downstream of said valve seat and a ball valve for injecting the fuel, swirled by said fuel swirling element, from said fuel injection port, and in which an amount of the fuel to be injected is controlled by controlling an opening and closing time period of the ball valve, wherein a cross sectional area of a flow passage from an inlet of the fuel swirling element till an outlet of the fuel injection port is made smaller toward the outlet of the fuel injection port continuously.

According to a third aspect of the invention, there is provided an electromagnetic fuel injection valve comprising a fuel swirling element disposed upstream of a valve seat for imparting a swirling motion to fuel, a fuel injection port formed downstream of said valve seat and a ball valve for injecting the fuel, swirled by said fuel swirling element, from said fuel injection port, and in which an amount of the fuel to be injected is controlled by controlling an opening and closing time period of the ball valve, wherein The fuel swirling element includes axial grooves into which the fuel is introduced from an axial direction of a valve body and radial grooves introducing the fuel from said axial grooves into a fuel swirling chamber at portions of the fuel swirling chamber eccentric from a center of the valve body, said radial grooves being tapered toward said fuel swirling chamber.

According to a fourth aspect of the invention, there is provided an electromagnetic fuel injection valve comprising a fuel swirling element disposed upstream of a valve seat for imparting a swirling motion to fuel, a fuel injection port formed downstream of said valve seat, a ball valve movable in an axial direction of a valve body for injecting the fuel, swirled by said fuel swirling element, from said fuel injection port, and means for controlling an opening and closing time period of said ball valve with a stroke amount which can make a flow rate of the fuel at a constant.

According to a fifth aspect of the invention, there is provided an electromagnetic fuel injection valve comprising a fuel swirling element provided upstream of a valve seat including a plurality of cutaways to which fuel is supplied, a fuel pool communicated with said cutaways and radial grooves communicated with said fuel pool eccentrically introducing the fuel from said fuel pool, a fuel injection port provided downstream of the valve seat, and a ball valve for injecting the fuel having a swirling force given by said fuel swirling element from said fuel injection port, wherein an amount of the fuel to be injected is controlled by controlling an opening and closing time period of said ball valve.

The fuel swirling element is to control a fuel flow flowing downward, a radial fuel flow flowing to the valve seat and the fuel injecting port and to control their pressure loss so as to be small. The fuel pressurized and given a swirling force by the fuel swirling element flows in the annular gap formed by the ball valve and the valve seat which is narrower than the flow passages of the fuel swirling element and thereafter, is injected through the fuel injection port of which cross sectional area is smaller than the annular area. Accordingly, the electromagnetic injection valve of the invention can effectively convert the potential energy of the pressurized fuel into the swirling velocity energy to introduce the fuel injection port and can inject and supply the fuel with a sufficient swirling force from the fuel injection port.

DESCRIPTION OF THE PREFERRED EMBODIMENT

Figure 1:
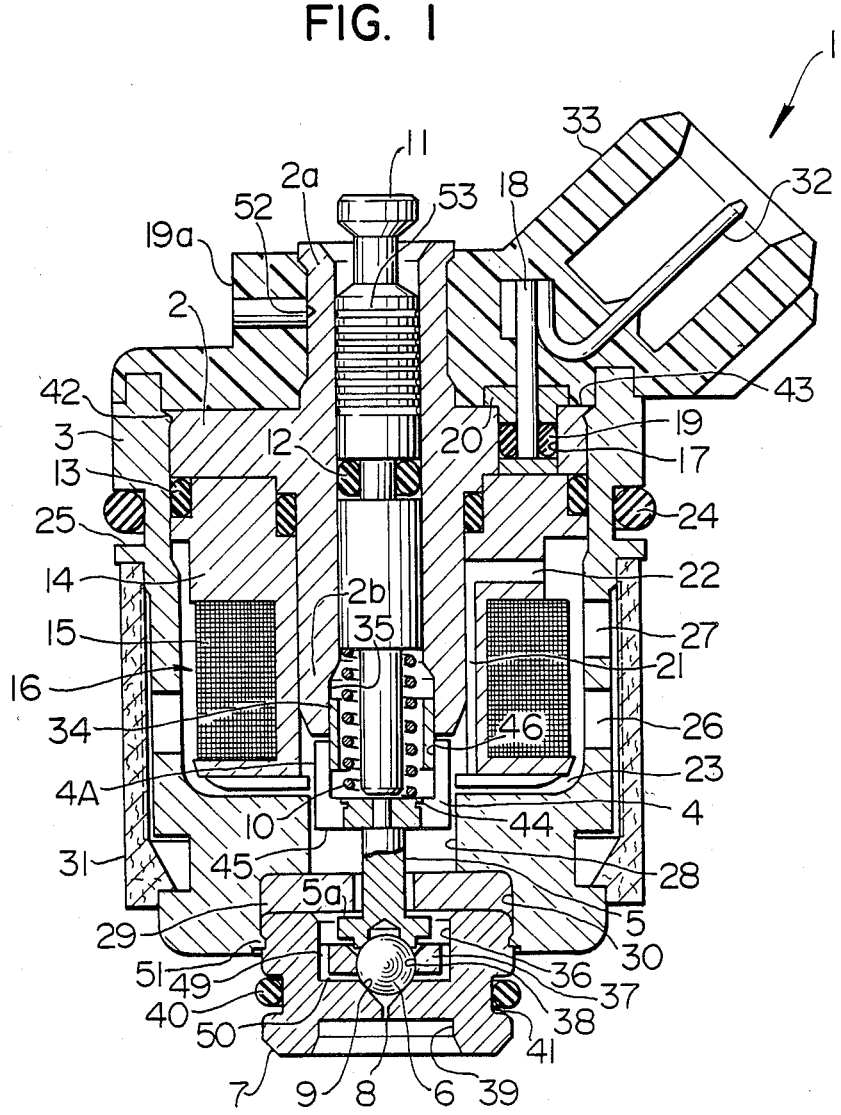
FIG. 1 is a vertical sectional view showing an electromagnetic fuel injection valve according to one embodiment of the invention.
Figure 2:
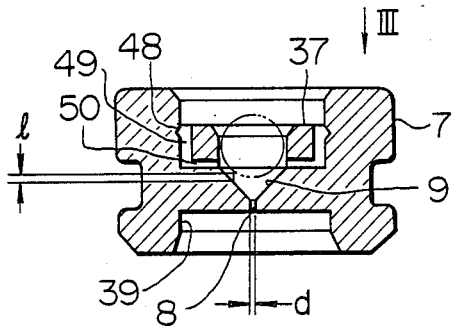
FIG. 2 is a vertical sectional view illustrative of an assembly of a fuel swirling element and a valve guide.
Figure 3:
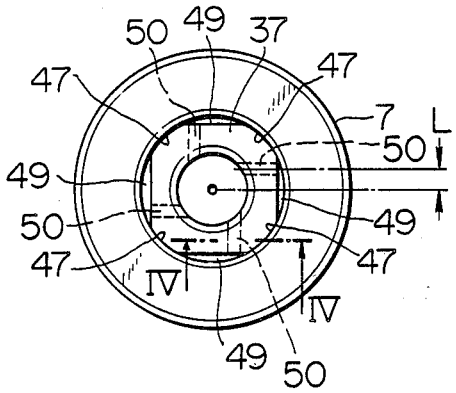
FIG. 3 is a view as viewed in a direction indicated by III in FIG. 2.

One embodiment of the invention will now be described with reference to FIGS. 1 to 9. The structure and operation of an electromagnetic fuel injection valve 1 (hereinafter referred simply to as a "injection valve") will now be described with reference to FIG. 1. The fuel injection valve 1 is of such type that a valve portion is opened and closed in accordance with ON/OFF signals of a duty calculated by a control unit (not shown), thereby performing fuel injection. A magnetic circuit comprises a cylindrical yoke 3 having a bottom, a core 2 having a plug body portion 2*a* for closing an opening of the yoke 3 and a post-like portion 2*b* extending along a centerline of the yoke 3 and a plunger 4 confronting to the core 2 with a gap. Along the centerline of the post-like portion 2*a* of the core 2, there is formed a hole into which inserted is a spring 10 serving as an elastic member for pressing a movable portion 4A against a seat surface 9 of an orifice 8 formed in a valve guide 7, the movable portion 4A being composed of the plunger 4, a rod 5 and a ball valve 6. In order to adjust a set load, an upper end of the spring 10 is held in contact with a lower end of a spring adjuster 11 inserted centrally into the core 2. In order to prevent the fuel from overflowing to the outside from a gap between the core 2 and the adjuster 11, an O-ring 12 is interposed therebetween. An O-ring 13 is also interposed into a gap between the core 2 and the yoke 3 in order to prevent the fuel from escaping to the outside. A coil 15 for magnetizing the magnetic circuit is wound around a bobbin 14 and is molded of plastics therearound. A terminal 18 of a coil assembly 16 composed of these components is inserted into a hole 17 formed in a flanged portion of the core 2, with an O-ring being interposed between the terminal 18 and the core 2. A collar 20 is adapted to cover an inlet of the hole 17 in order to prevent a mold resin 19*a* outside the injection valve 1 (hereinafter referred to as a yoke mold) from entering into the interior of the injection valve 1 during the molding process. There are formed a gap 21 between the bobbin 14 and the core 2, an upper passage 22 and a lower passage 23 as passages for the fuel and vapor of the fuel. An annular groove 25 is formed around the yoke 3, and an O-ring 24 is held therein in order to prevent the fuel from leaking from a gap between the injection valve 1 and a box-shaped socket (not shown). In the outer periphery of the yoke 3, there are formed an introduction passage 26 through which the fuel is introduced thereinto and a discharge passage 27 through which the excessive fuel containing gas bubbles stagnant in the fuel injection valve 1 is discharged. In the bottom of the yoke 3, there is formed a plunger receiving portion 28 for receiving the movable portion 4A. A valve guide receiving portion 30 that has a larger diameter than that of the plunger receiving portion 28 and is adapted to receive a stopper 29 and the valve guide 7 is formed to a tip end of the yoke 3. Around the yoke 3, there is provided an annular filter 31 for preventing dirt or foreign matter contained in the fuel existing in the piping from entering the valve seat side through the fuel introduction passage 26. A terminal 32 through which the signals from the control unit are transmitted to the coil 15 is connected to the terminal 18. These terminals 18 and 32 are molded with the mold resin to the upper end of the electromagnetic valve to form a mold connector 33. The movable portion 4A is structured by the plunger 4 made of magnetic material, the rod 5 connected at one end to the plunger 4, the ball valve 6 coupled to the other end of the rod 5, and a guide ring 34 that is fixed to the upper opening portion of the plunger 4 and is made of non-magnetic material. The guide ring 34 is guided by an inner wall 35 of a hollow portion formed in a tip end portion of the core 2 and the ball valve 6 is guided by an inner circumferential surface 38 of a cylindrical fuel swirling element 37 inserted into a hollow portion 36 of the valve guide 7. The seat surface 9 for the ball valve 6 is provided immediately below the cylindrical fuel swirling element 37 in the valve guide 7. The fuel injection port 8 is formed centrally in the seat surface 9. Furthermore, in the valve guide 7, there is formed a cylindrical recess 39 extending in the opposite direction to the seat surface 9. An O-ring 40 is interposed between the socket (not shown) and an outer peripheral surface of the valve guide 7 in order to seal the fuel. In the embodiment, a O-ring receiving portion 41 is formed as an annular groove around the valve guide 7.

An assembling method of the injection valve and an adjusting method of the flow rate will be described. An assembling method of the assembly of the electromagnetic portion will first be explained. After the O-ring 19 has been applied to the terminal 18 of the coil assembly 16, the terminal 18 is inserted into the hole 17 formed in the flanged portion of the core 2, and subsequently, the collar 20 is inserted from above the terminal 18. Thereafter, the O-ring 13 is mounted around the outer lower portion of the plug body portion of the core 2 and the assembly 16 is inserted into the yoke 3. Under this condition, a core contact surface portion 42 formed in an inner upper end portion of the yoke 3 is pressed in the axial direction, so that the material of the yoke 3 is made to be fluidized in a plastic manner in the radial direction into a groove formed around the plug body portion of the core 2, thus performing the fixture by the restriction force. Namely, a so-called "metal-flow process" is performed. In order to guide the ball valve 6 by the inner wall surface 38 of the fuel swirling element 37 and to guide the non-magnetic ring 34 by the tip end inner wall surface 35 of the core 2, that is, in order to guide the guided portion at the two locations to move in the axial direction, it is important that the exact concentricity between the inner diameter of the valve guide receiving portion 30 of the yoke 3 and the inner wall surface 35 of the core 2 is ensured in the movable portion. Therefore, the metal-flow process is carried out, while supporting the inner diameter of the receiving portion 30 of the valve guide 7 and the inner wall surface 35 of the core 2 accurately in concentricity. Thereafter, the terminal 32 is fixed to the terminal 18 by fastening means such as caulking (press-fitting), soldering, welding or the like. Then, this part is subjected to the resin molding.

An assembling method of the valve guide assembly will be explained. The valve guide assembly is composed of the movable portion 4A, the fuel swirling element 37 and the valve guide 7. With respect to the movable portion 4A, the ball valve 6 and the rod 5 made of stainless steel tempered and hardened are welded to each other by a resistor welding, a laser welding or the like. Subsequently, the other end of the rod 5 and the plunger 4 are fixed to each other by deforming the inner wall of the plunger 4 into a groove 44, formed in the outer periphery of the rod 5, by the metal-flow process. Also, the connection between the guide ring 34 and the plunger 4 is performed through the metal-flow process by supporting a surface 45, on the ball valve side of the plunger 4 with a member and pressing a guide ring contact portion 46 on the tip end inner peripheral edge of the plunger 4 in the axial direction, thereby imparting the radial restricting force to the guide ring 34.

The fuel swirling element 37 is formed into a cylindrical form by mold using a sintered alloy, and is press-fitted to the inner wall 36 of the valve guide 7. Namely, the outer circumferential surface 47 (at four locations) of the fuel swirling element 37 is deformed into a groove 48 of the valve guide 7 by the metal-flow process (see FIG. 2 and FIG. 3). Incidentally, although in the embodiment, the fixture is attained by the metal-flow process as described above, the function of the fuel swirling element 37 can be satisfied by fixing it with an elastic or resilient member in the direction II of FIG. 2.

In the fuel swirling element 37, there are formed axial grooves 49 and radial grooves 50. In the embodiment shown, the axial grooves 49 are formed in D-shape. These grooves 49 and 50 are formed for passage of the fuel introduced in the axial direction. The fuel passing through the grooves 49 is introduced radially inward by the grooves 50, of which centerlines do not cross the centeraxis. This structure is available to impart the swirl motion to the fuel to enhance the atomization of the fuel when the fuel is injected from the fuel injection port 8 formed in the valve guide 7.

The fuel swirling element 37 is designed and manufactured in view of the following consideration and is press-fitted to the inner wall surface 36 of the valve guide 7.

Figure 4:
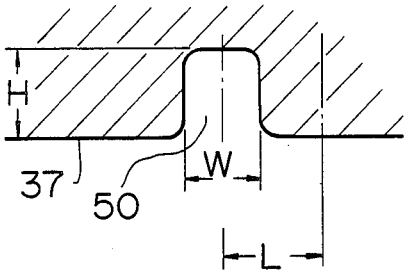
FIG. 4 is a cross sectional view taken along the line IV—IV of FIG. 3.

The factors affecting the static flow rate of the fuel involve a pressure drop of flow passages of the fuel swirling element 37 and a swirl force to be imparted to the fuel. The pressure drop in flow passage depends mainly upon a cross-sectional area of the grooves. A cross-sectional configuration of the radial groove 50 of the embodiment is shown in FIG. 4 (that is a cross-sectional view taken along the line IV—IV of FIG. 3). The cross-sectional area A1 is expressed by the following equation (1) using a hydrodynamic equivalent diameter which is the function of a width W and a depth H of the groove shown in FIG. 4:

$$A_1 = n \cdot \frac{\pi}{4}\left(\frac{2WH}{W+H}\right)^2 \tag{1}$$

where n is the number of the grooves.

The cross-sectional area A1 is determined so that the ratio $\sigma = A1/A3$ (A3 is the cross-sectional area of the fuel injection port 8 and expressed by the following equation) exists in a range between 1.5 and 6.5 and the pressure drop is reduced to a minimum possible level.

$$A_3 = \frac{\pi}{4} d^2 \tag{2}$$

Figure 5:
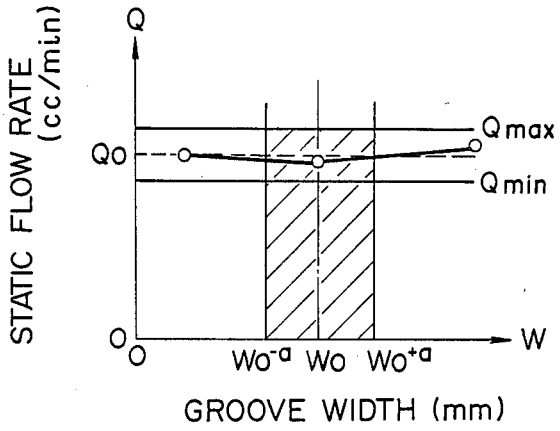
FIG. 5 is a graph showing an experimental result of a relationship between a groove width and a flow rate.
Figure 6:
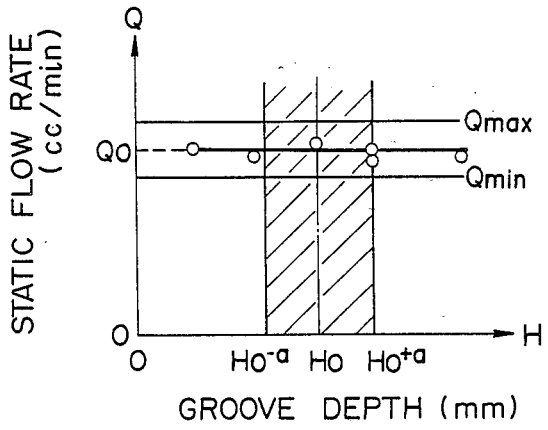
FIG. 6 is a graph showing an experimental result of a relationship between a groove depth and a flow rate.
Figure 7:
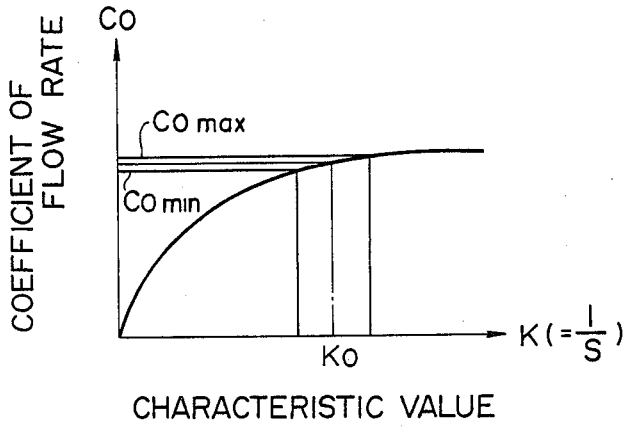
FIG. 7 is a graph showing a relationship between a fuel swirling strength and a coefficient of flow rate in accordance with the embodiment of the invention.

The results of the experiments conducted by the inventors are shown in FIGS. 5 and 6. It can be proved that the affect of the loss is very small.

FIG. 5 shows an affect of the groove width W to the static flow rate, in which a change rate of the flow rate in an allowance ± a relative to the reference 5 groove width $W_0$ is 0.2% or less. FIG. 6 shows an affect of the groove depth H to the static flow rate, in which a change rate of the flow rate in an allowance ± a relative to the reference groove depth $H_0$ is 0.1% or less. Therefore, the affects of the groove against the static flow rate are small and negligible under the above-described design conditions. Here, in FIGS. 5 and 6, the static flow rate Q0 is a target flow rate, Qmax represents +3% of Q0, and Qmin represents −3% of Q0. The allowance ±a is about 20 micrometers in the embodiment.

An affect of the swirl force to the static flow rate will be decreased. A swirl number S that is a parameter representative of the strength of the swirl is expressed in the ratio between "angular momemtum" and the multiple of "momentum in the axial direction of the injection" and "radius of the port". This swirl number S is finally given by the following equation.

$$\begin{aligned} S &= \text{(angular momentum)}/\{\text{(momentum in the axial direction of the injection)} \times \text{(diameter of the port)}\} \\ &= 2\sqrt{2} \cdot L/(nd_s^2) \end{aligned} \tag{3}$$

where

L is eccentricity of the groove (see FIG. 4);

ds is a value represented by the hydrodynamic equivalent diameter by using the groove width W and the groove depth H (see equation (1)); and n is the number of the grooves. An affect of the magnitude of the swirl number S to the static flow rate will be explained with reference to the following equation together with the results of the experiments conducted by the inventors. The flow rate Q is given by the following equation (4):

$$Q = Co\left(\frac{d}{2}\right)^2 \cdot \left(\frac{2g\,P}{\gamma}\right)^{0.5} \tag{4}$$

where Q is the flow rate, Co is coefficient of the flow rate, d is the diameter of the port, $\gamma$ is the specific weight, and P is the fuel pressure. The coefficient of the flow rate Co in the equation (4) is dependent on the characteristic value K, which is an inverted number of the swirl number S given by the equation (3) and their relation obtained from the experiment shown in FIG. 7. As is apparent from FIG. 7, in the embodiment, the grooves are designed so that the fuel is allowed to pass therethrough in a region where the change rate of the coefficient of flow rate Co is kept small. In other words, the magnitude of the swirl number S in the equation (3) can be selected by the eccentricity L of the grooves. Naturally, the eccentricity L is determined to a dimension to make the change rate of the coefficient of flow rate Co small. This is proved by the experimental results, obtained by the inventors, as shown in FIG. 8.

Figure 8:
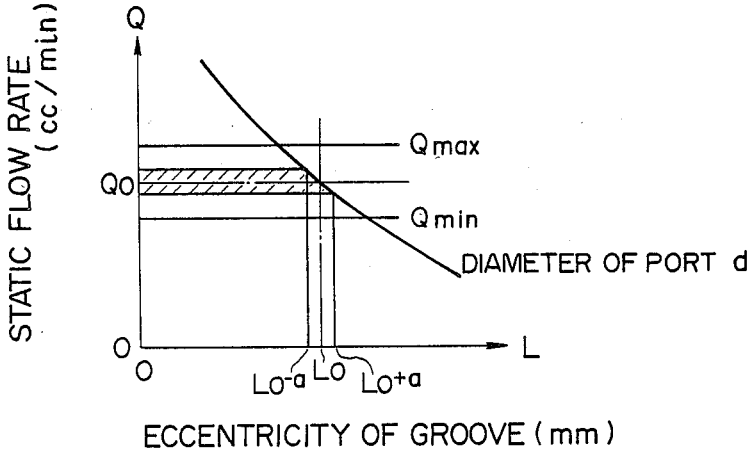
FIG. 8 is a graph showing a relationship between eccentricity of the groove and the flow rate.

In FIG. 8, the change rate of the static flow rate in an allowance ±a relative to the reference eccentricity $L_0$ is ±1% or less. This flow rate change corresponds to the hatched region in FIG. 8. It can be said that the flow rate change corresponds to the change of the coefficient of the flow rate Co from Comin to Comax shown in FIG. 7.

As described above, the affect of the fuel swirling element 37 to the change in static flow rate is relatively small. It is possible to provide a low cost fuel swirling element 37 with a simple structure that does not need a high mechanical precision. After the fuel swirling element 37 has been manufactured in desired dimensions with a relatively low mechanical precision allowance, the swirling element 37 is fixed by the metal-flow process to the groove 48 of the inner wall surface 36 of the valve guide 7.

Subsequently, an adjustment of a stroke of the movable portion 4A will be explained. The stroke can be determined by a dimension of a gap between the receiving surface 5*a* of a neck portion of the rod 5 and the stopper 29.

Figure 9:
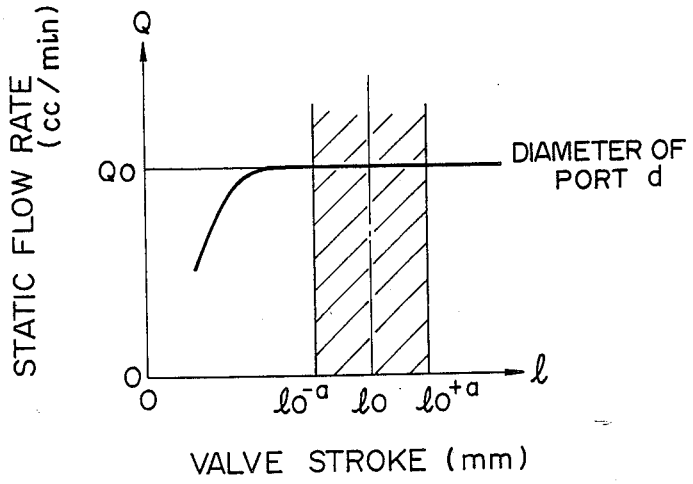
FIG. 9 is a graph showing a relationship between a valve stroke and the flow rate.

A result of an experiment as to an affect of the stroke ( to the static flow rate will be shown in FIG. 9. As is apparent from FIG. 9, the flow rate is abruptly increased in accordance with the increase of the stroke ( and will be gently, gradually increased to be kept substantially constant $Q_0$. The area A2 in the annular gap formed between the ball valve 6 and the valve seat 9 by a stroke is given by the following equation (5) referring to FIG. 10.

$$A2 = \pi\left(\frac{D_1 + D}{2}\right)\sqrt{\left(\frac{D_1 - D}{2}\right)^2 + h^2} \quad (5)$$

where $D_1$ is the lower side of the shown trapezoid, D is the upper side of the trapezoid, that is, the seat diameter, and h is the height of the trapezoid.

Using a ratio $\delta(=A_2/A_3)$ of the area $A_2$ to the area $A_3$ of the fuel injection port 8, the ratio δ giving a constant flow rate $Q_0$ becomes larger than 1. In the case of the embodiment, as shown in FIG. 9, the area $A_2$ is determined in a dimension having a sufficient margin in an allowance ±a relative to the reference stroke ($_0$. The ratio δ at the allowance of −a of the stroke ($_0$ is 2 or more. Incidentally, the dimension a is about 20 micrometers as described before.

As described above, the stroke amount of the movable portion 4A is an absolute amount that does not affect the static flow rate and is determined by the sufficiently wide allowance. In the prior art, it is necessary to adjust the stroke of the valve in desired range by grinding the end face of the valve guide and/or the receiving surface 5*a* of the neck portion of the rod 5 after a trial assembling in order to determine the flow rate.

According to this invention, it is sufficient to perform only the control of the dimensions of the components. Therefore, the assembling work is facilitated and simplified.

Figure 11:
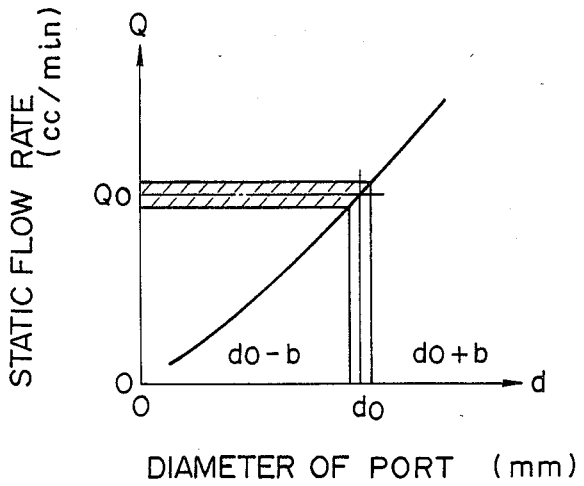
FIG. 11 is a graph showing a relationship between a diameter of a port and the flow rate.

An affect, to the static flow rate, of the fuel injection port 8 formed in the valve guide 7 will be explained. The static flow rate of the fuel passing through the single fuel injection port 8 is shown in FIG. 11. The change rate of the static flow rate in the allowance ±b relative to the reference port diameter $d_0$ is 1.5% or less. The value of b is about 5 micrometers.

As described before, a relationship of the cross-sectional area A3 of the fuel injection port 8 is given by the following formula by using the area A2 of the annular gap at the full stroke of the movable portion 4A and the groove area A1 of the fuel swirling element 37:

$$A1 > A2 > A3 \ldots \quad (6)$$

The injection valve 1 according to the embodiment is constructed so that the fuel static flow rate is determined by the fuel injection port 8.

Figure 10:
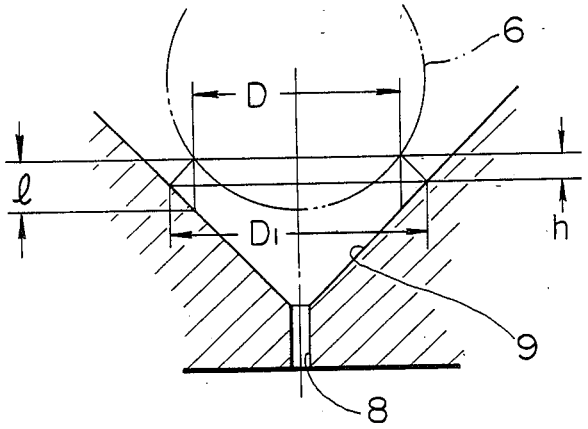
FIG. 10 is a view showing an annular gap formed between the ball valve and the valve seat.

The ratio δ is 2 or more as described before. In this case, the pressure drop of the fuel injection port 8 occupies 95% or more of the entire drop. It is supported that the foregoing measurement is carried out by the fuel injection port 8. That change rate of the flow rate considering the affect of the fuel swirling element 37 to the flow rate explained with reference to FIGS. 5 to 8 and the affect of the stroke to the flow rate explained with reference to FIGS. 9 and 10 is about ±1% means that the regulation of the fuel is effected by the fuel injection port 8.

As described above, the static flow rate is substantially out of the affect of the stroke. Although the static flow rate is changed by approximately ±1% by the fuel swirling element 37 and is changed by approximately ±1.5% by the port, the change is sufficiently suppressed within the level of ±3% that is on target with the injection valve assembly.

Namely, the fuel injection valve of the invention becomes a low cost injection valve which does not need a disassembling and reassembling and a reproducing suffering a high cost for the adjustment of the static flow rate. Incidentally, it is a matter of course that the static flow rate can be controlled within the objective precision even if the static flow rate at the port provided at the valve guide 7 is measured before the fuel swirling element 37 is press-fitted to the valve guide 7.

As described above, the assembled valve guide unit is inserted into the valve guide receiving portion 30 of the yoke 3 of the electromagnetic assembly together with the stopper 29 to assembly the two units. The two units are fixed to each other by the tip end inner circumferential wall of the yoke 3 into the groove 51 formed in the outer periphery of the valve guide 7 by the metal-flow process. In this case, the stopper 29 is set to a thickness to have a predetermined air gap in order that the tip end of the plunger 4 and the tip end of the core 2 are not brought into direct contact with each other when the movable portion 4A is attracted by the magnetic force. Then, the adjuster 11 keeping the spring 10 at the leading end thereof and having the O-ring 12 at the periphery thereof is inserted into the hole provided at the center of the core 2 from an opposite side of the valve guide 7. On the other hand, the filter 31 and the O-ring 24 are mounted on the outer periphery of the yoke 3 and is once received in an assistant member (not shown). Then the test of the fuel injection amount is commenced. In the fuel injection test, the injection amount is first measured under the condition that the movable portion 4A is fully stroked, and the fuel injection amount at this time is confirmed to be the desired fuel injection amount.

Thereafter, the response characteristics of the movable portion 4A is determined by changing a spring load of the spring 10 so that the fuel injection amounts during the constant cycle and the constant valve opening time period are set to a desired level. Then, the outer periphery of an upper projection 52 of the core 2 is pressed in the radial direction from the hole of the mold resin so that the inner wall of the core is invaded into the grooved portion 53 of the adjuster 11 for fixture.

The operation of the fuel injection valve thus constructed in accordance with the invention will now be described. The injection valve 1 is controlled in accordance with electrical ON/OFF signals applied to the electromagnetic coil 15 to actuate the movable portion to open/close the valve, thus performing the fuel injection. The electrical signals are applied to the coil 15 as pulses. When the current flows the coil 15, the magnetic circuit is formed by the core 2, the yoke 3 and the plunger 4, so that the plunger 4 is attracted toward the core 2. When the plunger 4 is moved, the ball valve 6 integrated with the plunger 4 is moved, so that it is separated away from the seat surface of the valve seat 9 of the valve guide 7 to open the passage to the fuel injection port 8. The fuel is pressurized by a fuel pump and adjusted by a fuel pressure regulator (not shown) to be made flow through the filter 31 from the introduction passage 26 to the interior of the electromagnetic valve assembly and is swirlingly supplied to the seat portion through the lower passage 23 of the coil assembly 16, the outer periphery of the plunger 4, the gap between the stopper 29 and the rod 5 and the grooves 49 and 50 of the fuel swirling element 37. Then the fuel is passed through the fuel injection port 8 to be injected to the intake manifold when the valve is opened.

When the electromagnetic coil 15 is deenergized, the movable portion 4A is pressed by the spring 10 and is moved toward the valve seat to close the seat surface of the valve seat 9 with the ball valve 6.

From the foregoing description, it has become apparent that it is unnecessary to provide an adjusting means for the flow rate. The contribution to the atomization of the fuel will be explained.

When the fuel reaches the fuel swirling element 37, the fuel flows from the axial grooves 49 formed in the swirling element 37 and the radial grooves 50 to the seat surface of the valve seat 9. In this case, the swirl flow will be generated at outlets of the radial grooves formed eccentrically of the axial centerline. The swirl flow is advanced on the downstream side through the annular gap formed in the seat surface of the valve seat 9, where there is almost no energy loss. The flow is grown to reach the fuel injection port while keeping a sufficient swirl energy.

As is apparent from the foregoing description, the pressure drop of the fuel flowing through the grooves 49 and 50 and the annular gap formed between the seat surface of the valve seat 9 and the ball valve 6 when the ball valve 6 is lifted is very small. Therefore, it is possible to swirlingly supply the fuel while keeping the initial fuel pressure and the fuel is injected from the fuel injection port 8 at a sufficient injection pressure and swirling force, so that an excellent atomized fuel can be obtained.

Figure 12:
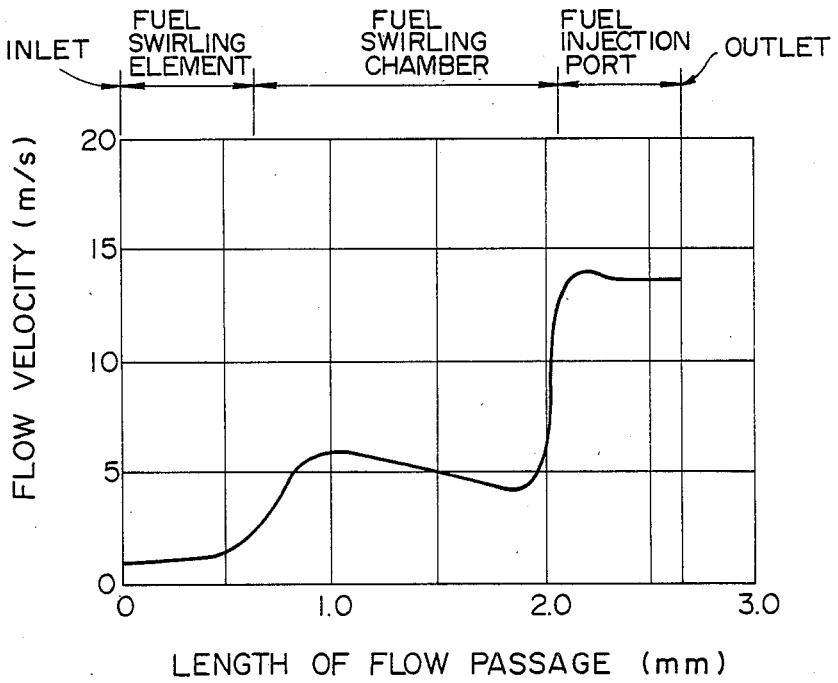
FIG. 12 is a graph showing a change of flow velocity along the flow passage of the fuel and the flow rate.

FIG. 12 shows a change of flow velocity of the fuel measured along the flow passage and the flow rate of the fuel in the case where the injection valve according to the invention is used. As is apparent from FIG. 12, the flow velocity at the fuel injection port is at maximum in the flow passage from the inlet, to the outlet. Therefore, it is possible to measure the flow rate only at the fuel injection port, i.e., the outlet orifice. This means that, if the outlet orifice is manufactured with a high accuracy on design, it is possible to measure the flow rate with high precision.

Figure 13:
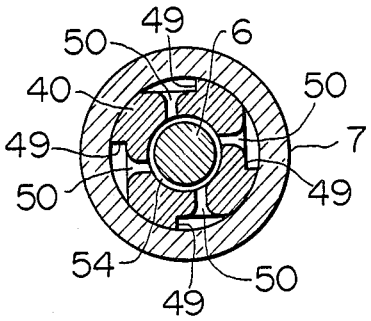
FIGS. 13 and cross-sectional views showing ball valve portions in accordance with other embodiments of the invention.

FIG. 13 shows another embodiment of the fuel swirling element, in which the fuel, swirling element 37 is formed so that the pressure loss through the grooves 49 and 50 is very small by the axial grooves 49 having a sufficient gap for allowing the fuel to pass therethrough and the radial grooves 50 each having a tapered shape without any fuel flow loss. The fuel is introduced into the first fuel swirl chamber 54.

Figure 14:
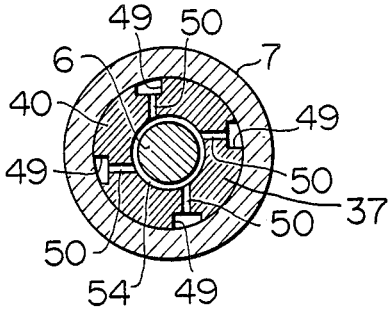

FIG. 14 shows still another embodiment of the fuel swirling element. In FIG. 14, reference numeral 37 denotes another fuel swirling element, 49 denotes axial groove and 50 denotes radial grooves.

According to this embodiment, it is possible to ensure the same effect as that of the first embodiment. Tee embodiment shown in FIG. 14 is advantageous in that the structure is relatively simple and it is possible to manufacture it in low cost.

The axial grooves 49 and the radial grooves 50 may be formed in any forms as desired, as is apparent from the foregoing description. Namely, it is possible to adjust the fuel injection pressure and the fuel swirling force, and it is possible to select the fuel spray pattern formed from the fuel injection port 8. Moreover, it is a matter of course that the same effect can be obtained even if the axial grooves 49 are made by chamfering the element.

Figure 15:
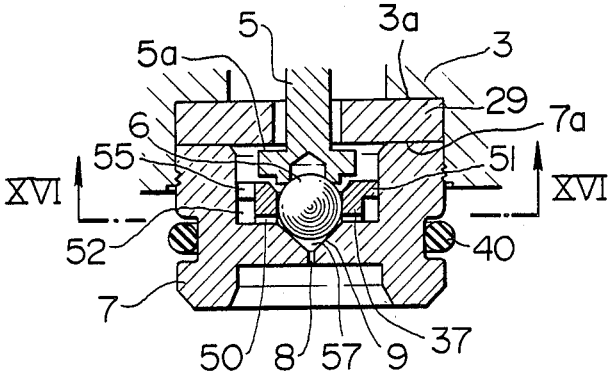
FIG. 15 is an enlarged sectional view showing a main part of another embodiment.
Figure 16:
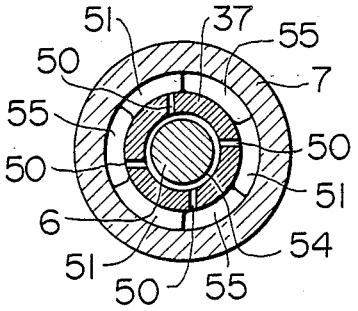
FIG. 16 is a cross-sectional view taken along the line XVI—XVI of FIG. 15.

FIG. 15 is an enlarged view of an electromagnetic fuel injection valve in accordance with still another embodiment of the invention. FIG. 16 is a cross-sectional view taken along the line XVI—XVI of FIG. 15.

In FIG. 15, the reference numeral 37 denotes the fuel swirling element having a flange 51 whose outer peripheral surface is fixed to the inner surface 36 of the valve guide 7. The reference numeral 52 denotes a fuel pool formed below the flange 51. The fuel flows through the radial grooves 50 to a first fuel swirling chamber. The reference numeral 55 denotes a plurality of cutaways formed in the flange 51 and communicated with the fuel pool 52.

The reference numeral 57 shows a second fuel swirling chamber defined by the conical valve seat 9 below the ball valve 6. This chamber assists the swirl flow of the fuel introduced from the first fuel swirling chamber.

The reference numeral 29 denotes the stopper inserted into a support surface 3*a* of the yoke 3 and a support surface 7*a* of the valve guide 7. The stopper 29 serves to restrict a gap between a surface 5*a* of the rod 5 and the stopper 29 to maintain a lift amount, that is, the upward movement of the ball valve 6.

In this embodiment, it is possible to obtain the same effect as in the first embodiment. In particular, according to this embodiment, it is possible to obtain a uniform distribution of the pressurized fuel before flowing into the radial grooves 50 and to effectively convert the pressurized fuel into the swirling motion.

What is claimed is:

1. An electromagnetic fuel injection valve comprising a fuel swirling element disposed upstream of a valve seat and having grooves for imparting a swirling motion to fuel; a fuel injection port formed downstream of said valve seat; and a ball valve for injecting the fuel, swirled by said fuel swirling element, from said fuel injection port; and in which an amount of fuel to be injected is controlled by controlling an opening and closing time period of the ball valve; wherein an area of an annular gap formed between the ball valve and the valve seat when the ball valve is lifted is smaller than a cross sectional area of the grooves of the fuel swirling element is larger than a cross sectional area of the fuel injection port.

2. An electromagnetic fuel injection valve comprising a fuel swirling element disposed upstream of a valve seat for imparting a swirling motion to fuel; a fuel injection port formed downstream of said valve seat; and a ball valve for injecting the fuel, swirled by said fuel swirling element, from said fuel injection port; and in which an amount of the fuel to be injected is controlled by controlling an opening and closing time period of the ball valve; wherein the cross sectional area of a flow passage from the inlet of the fuel swirling element to an outlet of the fuel injection port progressively decreases in a direction toward the outlet of the fuel injection port.

3. An electromagnetic fuel injection valve comprising a fuel swirling element disposed upstream of a valve seat for imparting a swirling motion to fuel; a fuel injection port formed downstream of said valve seat; and a ball valve for injecting the fuel, swirled by said fuel swirling element, from said fuel injection port; and in which an amount of the fuel to be injected is controlled by controlling an opening and closing time period of the ball valve; wherein the fuel swirling element includes axial grooves into which the fuel is introduced from an axial direction of a valve body and radial grooves introducing the fuel from said axial grooves into a fuel swirling chamber at portions of the fuel swirling chamber eccentric from a center of the valve body, said radial grooves being tapered toward said fuel swirling chamber.

4. An electromagnetic fuel injection valve claimed in claim 3, wherein each of said axial grooves has a D-shaped cross section.

5. An electromagnetic fuel injection valve comprising a fuel swirling element disposed upstream of a valve seat for imparting a swirling motion to fuel, a fuel injection port formed downstream of said valve seat, a ball valve movable in an axial direction of a valve body for injecting the fuel, swirled by said fuel swirling element, from said fuel injection port, and means for controlling an opening and closing time period of said ball valve with a stroke amount which can produce a constant flow rate of the fuel, wherein said stroke amount of the ball valve is an amount in which a ratio of an area of an annular gap formed between said ball valve and said valve seat with respect to a cross sectional area of said fuel injection port becomes larger than 1 and a ratio of a cross sectional area of said radial grooves of said fuel swirling element with respect to said cross sectional area of said fuel injection port becomes larger than 1.5.

* * * * *

UNITED STATES PATENT AND TRADEMARK OFFICE

CERTIFICATE OF CORRECTION

PATENT NO. : 4,887,769

DATED : Dec. 19, 1989

INVENTOR(S) : OKAMOTO, et al

It is certified that error appears in the above-identified patent and that said Letters Patent is hereby corrected as shown below:

On the front page:

Please change "[73] Assignee: Hitachi, Ltd., Tokyo, Japan" to --[73] Assignee: Hitachi, Ltd. and Hitachi Automotive Engineering Co., Ltd., both of Japan--.

Signed and Sealed this

Eleventh Day of June, 1991

*Attest:*

*Attesting Officer*

HARRY F. MANBECK, JR.

*Commissioner of Patents and Trademarks*